United States Patent [19]

Hayward

[11] 4,355,857

[45] Oct. 26, 1982

[54] COAX PUSH-ON TEST CONNECTOR

[76] Inventor: Robert D. Hayward, 6142 N. 18th Ave., Phoenix, Ariz. 85015

[21] Appl. No.: 204,853

[22] Filed: Nov. 7, 1980

[51] Int. Cl.[3] ..... H01R 17/18

[52] U.S. Cl. ..... 339/177 R; 339/255 R

[58] Field of Search ..... 339/177, 255

[56] References Cited

U.S. PATENT DOCUMENTS

| | | | |
|---|---|---|---|
| 3,590,377 | 6/1971 | Sorger | 339/177 R |
| 3,879,102 | 4/1975 | Horak | 339/177 R X |
| 4,037,909 | 7/1977 | Trompeter et al. | 339/177 R |
| 4,046,451 | 9/1977 | Juds et al. | 339/177 R |
| 4,281,888 | 8/1981 | Seaman | 339/255 R X |

*Primary Examiner*—Howard N. Goldberg
*Assistant Examiner*—Frank H. McKenzie, Jr.
*Attorney, Agent, or Firm*—Don J. Flickinger

[57] ABSTRACT

In a push-on cable connector assembly, the connector is merely pushed onto the coaxial cable and positive pressure devices maintain electrical continuity at points of contact between the outer conductor of the cable undergoing tests and that of the connector assembly and between the inner conductor of said cable and that of the connector assembly. A spring fingered ferrule provides positive contact pressure with the outer conductor of the coaxial cable. Uniquely, a resilient spring contact probe, commonly applied in production testing of printed circuit boards, is adapted as the center conductor of the push-on connector assembly and provides positive contact pressure between the center conductor of the cable undergoing tests and the center conductor of the push-on connector assembly. A standard coaxial connector of the designer's choice is provided as part of the push-on cable connector assembly.

10 Claims, 5 Drawing Figures

COAX PUSH-ON TEST CONNECTOR

BACKGROUND

1. Field of the Invention

The invention relates to the field of coaxial cable connectors. In particular, the invention relates to coaxial connectors particularly adapted for use during tests of coaxial cable parameters. More specifically, the invention relates to coaxial test connectors which may be made up to an associated coaxial cable by a simple push-on, slide fit connection.

2. Prior Art

Coaxial cables are precision devices. The characteristic impedance of coax cables is determined not only by the ratio of the diameters of the outer and inner conductors, but also upon the coincidence of the axes of these conductors. An eccentric line results when the inner conductor is displaced from the central axis of the outer conductor and the characteristic impedance of the coaxial cable is modified in accordance with the degree of such eccentricity. A cable inadvertently bent about too small a radius may experience a displacement of its center conductor from its nominal coaxial position. An indentation impressed into the outer conductor will also have adverse affects on the characteristic impedance of the coaxial transmission line.

The characteristic impedance and the electrical line length of a coaxial transmission line is dependent upon the dielectric material contained within the outer conductor and surrounding the inner conductor. The characteristic impedance varies inversely as the square root of the dielectric constant of the dielectric employed. Production anomalies, which may introduce variations in the dielectric constant, can cause significant impedance mismatches to exist along the length of a coaxial transmission line.

In addition to the affects on characteristics impedance of conductor eccentricity and dielectric constant variations, the ability of a given coaxial cable to withstand high voltage breakdown may also be adversely affected by these factors.

Since the physical deformation and production inadequacies which can produce problems in characteristic impedance of the line and its ability to withstand high voltage breakdown are frequently such as to be unobservable in the course of a visual examination of the coaxial cable, electrical testing of the cable is carried out with some frequency between the time at which the cable is fabricated and that at which it is finally emplaced and utilized within an operating system. Even then, there will be occasions to recheck cable parameters after it has been finally installed within a system. However, tests under these circumstances are usually facilitated by the fact that a cable already installed within a system will be provided with coaxial connectors to facilitate terminating the cable runs into various equipments and devices.

Certain coaxial cable tests may be conducted without the need for providing coaxial cable connectors on the cable undergoing test. Examples of such tests are simple DC continuity checks of the inner and outer conductors including simple DC resistance measurements with an ohmmeter, and tests of the coaxial structure to withstand a specified high voltage impressed across inner and outer conductors without breaking down. However, even these tests will often be facilitated by the use of coaxial connectors on the transmission line.

Certain electrical tests cannot be properly performed other than by use of cables equipped with proper coaxial connectors. Such tests include the measurement of the characteristic impedance of the line by means of time domain reflectometry; structure return loss measurements by means of frequency domain reflection bridge equipment; and tests of attentuation utilizing frequency domain volt meter measurements.

The tests noted above are typical of tests which may be performed by the manufacturer of the coaxial cable at the point of fabrication to assure that the cable has been manufactured to specified performance levels and applicable tolerances. Most frequently, the cable will be tested while it is still on the reel. Both ends of the cable are available and each has to be modified in order to accept the coaxial connectors necessary for the performance of the various tests.

The cable is then shipped to the purchaser who will usually perform acceptance tests to assure that the cable meets the purchase specifications. The manufacturer does not ship the cable with coaxial connectors in place at each end. Thus, the purchaser, in order to perform acceptance tests, will have to once more emplace coaxial connectors on the cable ends. This generally means another modification of the cable ends since there is a high likelihood of cable-end damage having been incurred during shipment of the cable from the manufacturing facility.

The handling which a cable receives in the course of its installation, for example, in an elevated run between poles, in interior cable runs and conduit, or in underground trenches dictates the need for additional testing so as to ascertain that the cable installation has been achieved without damage to the cable. Once more, the ends of the cable will have to be prepared to accept a connector since cable ends originally so prepared will in all likelihood have been damaged in the course of installation of the cable.

The reason a cable end is likely to be damaged results from the manner in which it is typically modified to accept a coax connector. Usually, when so modified, the center conductor of the coaxial cable will protrude beyond the extreme ends of the outer conductor by one-half inch or more. This configuration readily lends itself to being damaged as a result of center conductor distortion. Further, it is not unlikely that the extreme ends of the outer conductor will be damaged or distorted by a blow in the course of transporting and handling the cable.

A considerable amount of time must be spent in preparing the cable ends each time a connector is to be emplaced thereon. For example, assume that the particular coaxial cable in question consists an aluminum outer conductor and a solid copper inner conductor with a dielectric medium surrounding and supporting the inner conductor. To prepare the end of the cable to accept a conventional coaxial connector, a length of outer conductor must be removed. This step leaves exposed a length of inner conductor surrounded by a dielectric medium. Next, the dielectric is removed so as to expose the center conductor of the coaxial cable. The center conductor must be cleaned to remove all dielectric material, and its extreme end must be de-burred to assure its facile assembly with the components of the coaxial connector. The coaxial connector is then assembled to the cable and tightened in place.

Those skilled in the art will recognize that there are a variety of commercially available coaxial connectors available for use with coaxial cable.

It is an object of the present invention to provide a coaxial connector which may be connected to a coaxial cable with minimal modification of the end of said cable.

It is a further objective of the invention to provide a coaxial cable connector which may be readily assembled to a coaxial cable which has had its end square/-flush cut.

It is a specific objective of the invention to provide a coaxial connector which may be simply pushed-on to the square cut end of a coaxial cable in order to make the necessary connection to said cable to permit tests to be performed on said cable.

SUMMARY OF THE INVENTION

The invention is a coaxial connector which provides push-on connection to the end of a coaxial cable. The push-on connector comprises slidable pressure contact means for slidably positioning said connector on the outer conductor of a coaxial cable. When the connector has been so positioned, the slidable pressure contact means maintains contact with the outer conductor so as to provide electrical continuity between itself and said outer conductor. The push-on connector includes a resilient in-line pressure contact means for resiliently maintaining in-line contact with the center conductor of the coaxial cable when the slidable pressure contact means has been slidably positioned onto the outer conductor. The resilient in-line pressure contact means provides electrical contact between itself and the center conductor of the coaxial cable. In a preferred embodiment of the invention disclosed herein, the slidable pressure contact means comprises annular, spring finger means for enveloping the outer conductor of the coaxial cable and maintaining electrical contact therewith. The resilient pressure contact means at the center conductor comprises a spring loaded, extensible center conductor within the push-on connector. In the presently preferred embodiment of the invention, a coaxial transition couples both the slidable and the resilient in-line pressure contact means to a standard coaxial connector. This coaxial transition comprises an outer conductor coupled to the slidable pressure contact means and an inner conductor coupled to the resilient in-line pressure contact means. The inner conductor of the transition comprises the spring-loaded extensible shaft. This extensible shaft is coupled to an in-line pressure contact which maintains contact with the center conductor of the coaxial cable. The opposite end of this transition center conductor is adapted to be coupled to the center conductor of a standard coaxial connector. In the presently preferred embodiment to be disclosed herein, the inner conductor of the transition section of the push-on connector comprises a resilient spring contact probe such as is generally employed in production testing of bare and loaded printed circuit boards, wire wrapped back planes and in other applications where circuit access requires a compliant contact system.

DETAILED DESCRIPTION OF THE INVENTION

Since the connector of the invention may be readily pushed-on or pulled off of a coaxial cable, the push-on connector, the subject of this disclosure, is intended primarily for test purposes rather than for permanent installation although, those skilled in the art will readily conceive of cable gripping devices well known in the prior art for anchoring the push-on connector permanently in position on a coaxial cable.

Figure 1:
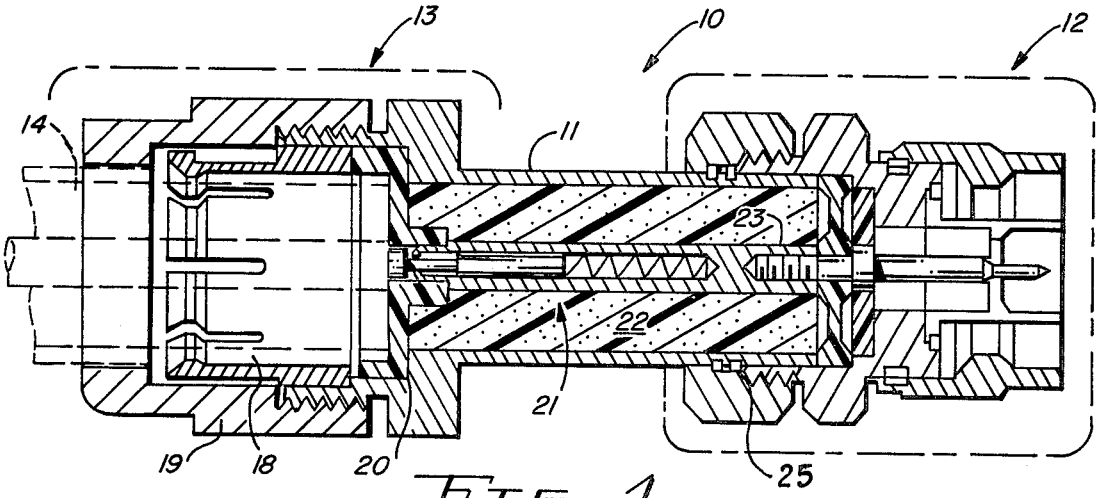
FIG. 1 is a cross-sectional view of the push-on coaxial connector showing the manner in which a square cut coaxial cable may be readily coupled to the connector without the need for further modification.

The push-on cable connector assembly 10 is illustrated in cross-section in FIG. 1. The connector assembly 10 is comprised of a coaxial transition section 11 which couples a standard coaxial connector 12 (here illustrated, but not limited to, a type N coaxial connector) to a push-on cable connector 13.

Figure 2:
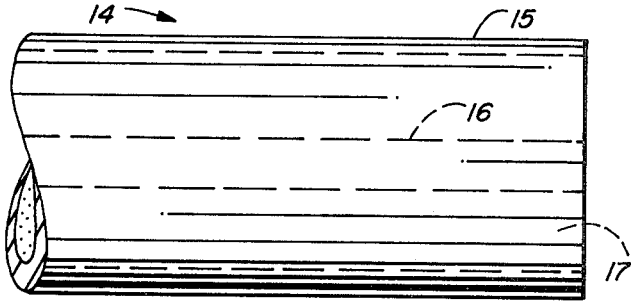
FIGS. 2 and 3 are side and end views, respectively, of a coaxial cable illustrating the configuration thereof and identifying the cable elements.
Figure 3:
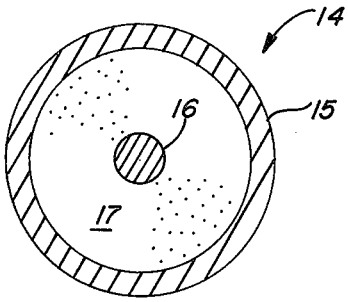

FIGS. 2 and 3 illustrate the coaxial cable section in side and end view, respectively. The coaxial cable 14 is comprised of an outer conductor 15 and inner conductor 16. The axis of inner conductor 16 is coaxial with the axis of outer conductor 15. A dielectric 17 supports inner conductor 16 within outer conductor 15 and determines certain of the electrical characteristics of the cable.

For use with the push-on connector 10, coaxial cable 14 is prepared by making a clean, square, flush cut across the cable as illustrated in FIG. 2. Connector 10 is then simply positioned on cable 14 by sliding the connector 10 down over the square cut end of cable 14 and along the exposed outer conductor 15. This joining of cable 14 to connector 10 is shown in FIG. 1 where cable 14 is illustrated in phantom outline.

Push-on connector 10 is provided with an annular, spring finger ferrule 18 which slidingly maintains a pressure contact with the outer conductor 15 of cable 14. This pressure contact between the spring fingers of ferrule 18 and the outer conductor 15 provides electrical continuity between the cable outer conductor and the ferrule. Ferrule 18 may be a press fit into transition outer conductor 11 to provide electrical continuity therewith. Guide 19 provides means for guiding cable 14 into contact with ferrule 18. Guide 19 also provides protection for the spring fingers of ferrule 18 and aids in maintaining ferrule 18 in contact with transition outer conductor 11.

With cable 14 in place within push-on connector 10 as illustrated in FIG. 1, coax cable center conductor 16 will bear against transition center conductor 21 to provide electrical continuity between the cable center conductor 16 and transition center conductor 21.

One end of transition center conductor 21 is supported and captivated by dielectric bead 20. This bead 20 is sized and configured as required to provide an impedance-matched junction between cable center conductor 16 and transition center conductor 21. The manner by which the size and shape of dielectric bead 20 is determined is well known to those in the prior art.

At the right-hand side of push-on connector 10, as illustrated in FIG. 1, is coupled a standard type N coaxial connector 12. Standard connector 12 is maintained in position on transition outer conductor 11 by compression rings 25 in a manner well known to those skilled in the art. Transition center conductor 21 is coupled to center contact 23 of standard connector 12 which provides support and further captivation of transition center conductor 21.

The dielectric medium 22 within the transition section between push-on connector 13 and standard connector 12, as well as the ratio of the inside diameter of transition outer conductor 11 to the diameter of transition inner conductor 21 are chosen to provide the proper impedance structure to match the push-on connector impedance to that of the standard connector impedance.

Figure 5:
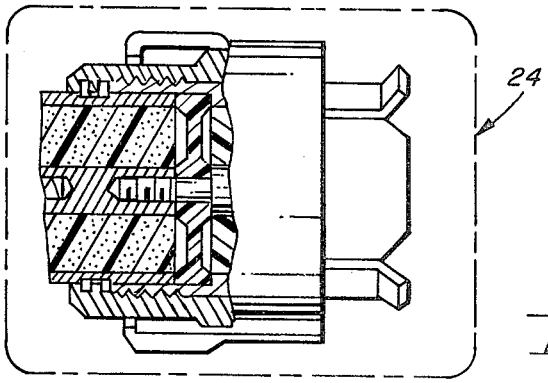
FIG. 5 illustrates a standard coaxial connector different from that utilized with the push-on cable connector of FIG. 1 to show the broad adaptable range of standard connectors which may be employed with the invention.

As suggested by the illustration of FIG. 5 showing a GR type connector coupled to transition outer conductor 11 and transition center conductor 21, push-on connector assembly 10 will accommodate various types of standard coaxial connectors as may be required to provide a push-on cable test connector to satisfy the connector type requirements of the associated test equipment.

For good electrical performance, it is necessary that a low loss consistent electrical contact be maintained between coaxial cable 14 and push-on connector 13 of connector assembly 10. The positive pressure applied by the spring fingers of ferrule 18 provide and maintain good electrical continuity between outer conductor 15 of cable 14 and cable assembly 10. To provide a consistent low loss electrical continuity connection between inner conductor 16 of cable 14 and transition inner conductor 21 of connector assembly 10 requires that some positive pressure be maintained at the junction of these two center conductors just as the spring fingers of ferrule 18 maintain a positive pressure on the outer conductor 15 of cable 14. To this end, transition center conductor 21 is provided with a resiliently extensible contact 2123 (FIG. 4) to maintain positive contact with inner conductor 16 of coaxial cable 14.

Figure 4:
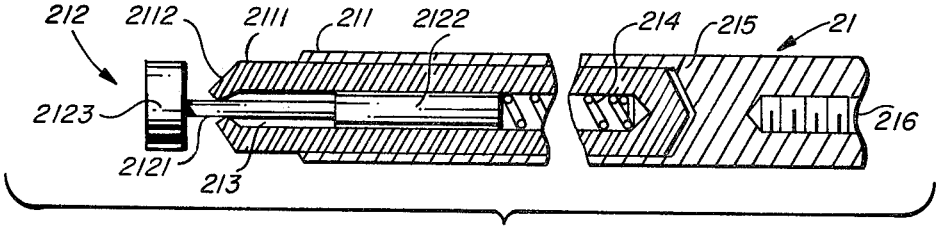
FIG. 4 is a detailed cross-sectional illustration of the center conductor of the push-on connector detailing the resiliently extensible in-line contact.

FIG. 4 illustrates transition center conductor 21 in greater detail than is provided in FIG. 1. Transition inner conductor 21 is comprised of a cylindrical body 211 and extensible section 212 which is supported within a central bore 213 under the resilient pressure provided by spring 214. Body 211 is provided with an exposed shoulder section 2111 which slidingly mates with dielectric bead support 20.

Resiliently extensible contact 212 is provided with a reduced diameter shaft 2121 which is guided by the close proximity provided by the rolled shoulders 2112 of body 211. An enlarged diameter shaft section 2122 is restricted in passage by shoulders 2112 and thus is captivated within bore 213 of body 211. Extensible length 212 is provided with an enlarged diameter section 2123 maintained external of bore 213 which provides the actual contact with the center conductor 16 of coaxial cable 14. The contact pressure between cable center conductor 16 and extensible contact 2123 is maintained at a positive pressure level by the resilient urging of spring 214 against the end of shaft section 2122.

In practice, cylindrical body 211 of transition center conductor 21 may be a resilient spring contact probe such as manufactured and sold by Assembly and Test Equipment Corporation of Pomona, California. Such probes are commonly applied in production testing of bare and loaded printed circuit boards, wire wrapped back planes and other applications where circuit access or function requires a complaint contact system. Cylindrical body/spring contact probe 211 is disclosed here as being housed in a receptical 215. This permits ease of replacement of spring contact probe 211 to eliminate the effect of wear and tear brought on by repetitious use of connection 10. Indeed all parts are readily replaceable so that the performance effectiveness of the connector may be maintained over long-life usage.

The end of receptical 215 opposite resilient spring contact 2123 is provided with a bore 216 which may be thread-coupled or solder fastened to the center contact 23 of a standard coaxial connector such as 12 or 24.

What has been disclosed is the means and method for providing a push-on cable connector assembly wherein the connector is merely pushed onto the coaxial cable and positive pressure devices maintain electrical continuity at points of contact between the outer conductor of the cable undergoing tests and that of the connector assembly and between the inner conductor of said cable and that of the connector assembly. A spring fingered ferrule provides positive contact pressure with the outer conductor of the coaxial cable. Uniquely, a resilient spring contact probe, commonly applied in production testing of printed circuit boards, is adapted as the center conductor of the push-on connector assembly and provides positive contact pressure between the center conductor of the cable undergoing tests and the center conductor of the push-on connector assembly. A standard coaxial connector of the designer's choice is provided as part of the push-on cable connector assembly.

A preferred embodiment of the invention has been disclosed. Those skilled in the art will conceive of other embodiments satisfying the same function and which will fall within the spirit and scope of the invention herein disclosed. It is intended that all such embodiments shall fall within the ambit of protection provided by the claims attached hereto.

Having described my invention in the foregoing specification and drawings in such a clear and concise manner that those skilled in the art may readily understand and simply practice the invention, that which I claim is:

1. Coaxial connector means providing push-on connection to the end of a coaxial cable comprising slidable pressure contact means for slidably positioning said connector on the outer conductor of a coaxial cable and for maintaining contact therewith when so positioned so as to provide electrical continuity between itself and said outer conductor; and resilient in-line pressure contact means for resiliently maintaining in-line contact with the center conductor of a coaxial cable on whose outer conductor said slidable pressure contact means has been slidably positioned so as to provide electrical contact between itself and said center conductor.

2. The coaxial connector means of claim 1 wherein said slidable pressure contact means comprises annular spring finger means for enveloping said outer conductor of a coaxial cable and maintaining electrical contact therewith.

3. The coaxial connector means of claim 1 wherein said resilient pressure contact means comprises a spring loaded extensible center conductor of said coaxial connector means.

4. The coaxial connector means of claim 1 further comprising coaxial transition means coupled to both said slidable and said resilient in-line pressure contact means for providing impedance matched electrical continuity to standard coaxial connector means.

5. The coaxial connector means of claim 4 further comprising coupling means for coupling a standard coaxial connector to said transition means.

6. The coaxial connector means of claim 5 wherein said coaxial transition means comprises:

outer conductor means coupled to said slidable pressure contact means; and inner conductor means coupled to said resilient in-line pressure contact means.

7. The coaxial connector means of claim 6 wherein said inner conductor means comprises a spring loaded extensible shaft.

8. The coaxial connector means of claim 7 wherein said resilient in-line pressure contact means comprises an in-line pressure contact coupled to said spring loaded extensible shaft.

9. The coaxial connector means of claim 8 wherein said inner conductor means further comprises coupling means for coupling said inner conductor means to the center conductor of standard coaxial connector means.

10. The coaxial connector means of claim 5 wherein said inner conductor means comprise a resilient spring contact probe as is generally employed in production testing of bare and loaded printed circuit boards, wire wrapped back planes and in other applications where circuit access requires a compliant contact system.

* * * * *